US005899043A

United States Patent [19]

Reay

[11] Patent Number: 5,899,043

[45] Date of Patent: May 4, 1999

[54] DUCTILE-FAILURE ANCHORS FOR CONCRETE ELEMENTS

[75] Inventor: Alan Michael Reay, Christchurch, New Zealand

[73] Assignee: Engineering Certifiers Ltd., Christchurch, New Zealand

[21] Appl. No.: 08/759,141

[22] Filed: Dec. 2, 1996

[30] Foreign Application Priority Data

Dec. 18, 1995 [NZ] New Zealand ..... 280690
Jun. 28, 1996 [NZ] New Zealand ..... 286904

[51] Int. Cl.[6] ..... E04B 1/38

[52] U.S. Cl. ..... 52/707; 52/99; 52/125; 52/701; 52/703; 294/89; 294/86.23

[58] Field of Search ..... 52/699, 700, 701, 52/703, 704, 706, 707, 708, 711, 125, 99; 294/83, 86.23, 86.13, 89

[56] References Cited

U.S. PATENT DOCUMENTS 3,705,469 12/1972 Eriksson ..... 52/701 X
4,017,115 4/1977 Holt et al. ..... 52/707 X
4,018,470 4/1977 Tye ..... 52/707 X
4,179,151 12/1979 Tye .
4,290,638 9/1981 Manning .
4,325,575 4/1982 Holt et al. ..... 52/707 X
5,660,020 8/1997 Reay .
5,671,582 9/1997 Reay .

*Primary Examiner*—Christopher Kent
*Assistant Examiner*—Yvonne Horton-Richardson
*Attorney, Agent, or Firm*—Greer, Burns & Crain, Ltd.

[57] ABSTRACT

The invention relates to a ductile-failure anchor (2, 32) for concrete elements (3, 39) used in construction. Each anchor (2, 32) includes a plug (4, 34) attached to a securing element (5, 5*a* or 55) and secured within each concrete element (3, 39). The securing element may included folded bars or a strap 5*a*. The securing element (5, 55) is placed about the plug (4, 34) and either secured in place (a first option) or held in position about the plug (4, 34) by supports 38 (second option). Each securing element (5, 55) includes at least two regions (10), each region (10) being of a predetermined length and cross-sectional area. When the anchor (2, 32) is overloaded each region (10) fails in a ductile manner before the burst strength of any part of the concrete element (3, 39) is reached.

20 Claims, 4 Drawing Sheets

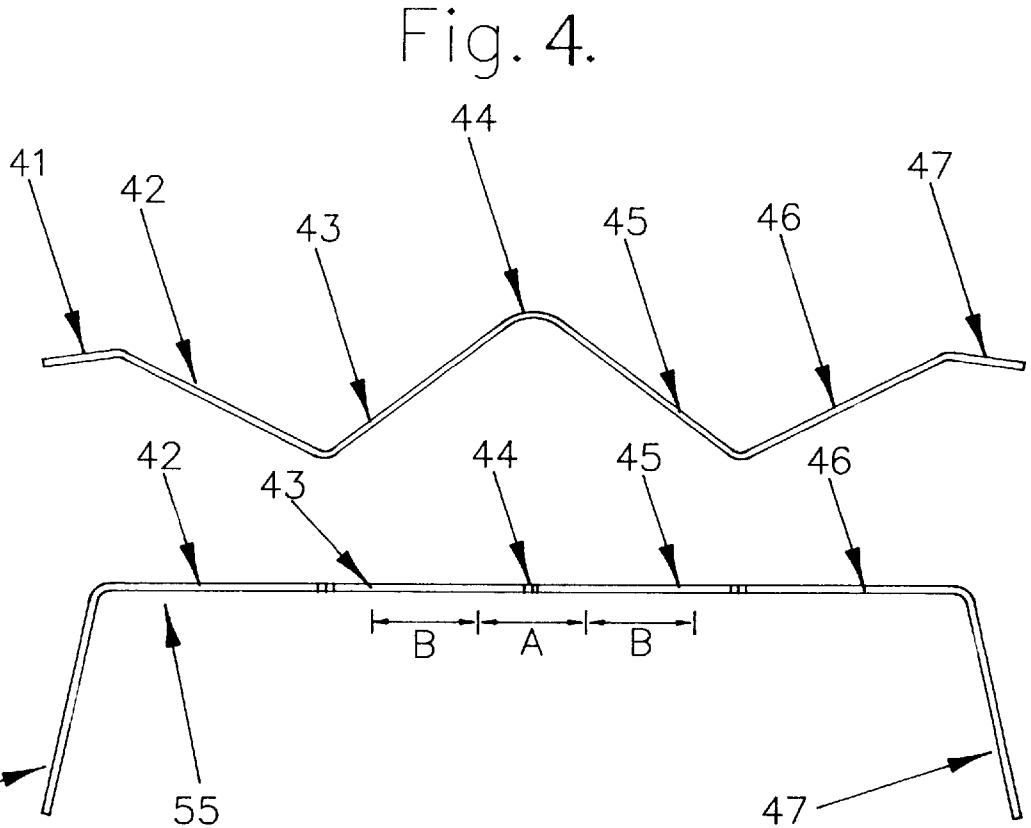
Fig. 4.
Fig. 5.
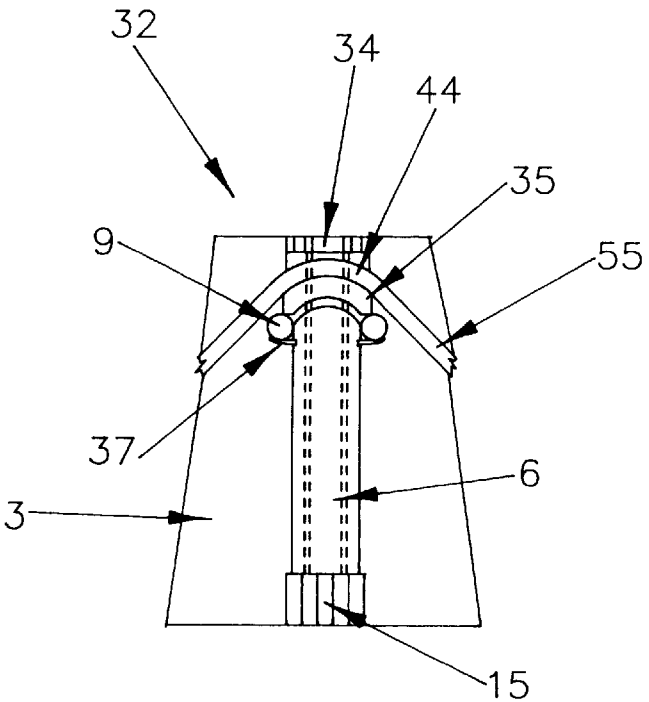
Fig. 3.

DUCTILE-FAILURE ANCHORS FOR CONCRETE ELEMENTS

TECHNICAL FIELD

The present invention relates to ductile-failure anchors for concrete elements which are cast into said concrete elements and which provide tensile or shear connection points to other concrete elements and which, when overloaded, fail in a ductile manner.

BACKGROUND ART

At present fixing anchors cast into concrete consist of a screw threaded element attached to reinforcing rods within the concrete element, into which a threaded bar or other connecting element can be secured. The threaded bar is used to connect one concrete element to another. It is now essential that it such connections are going to fail, due to an earthquake or other building disturbance, that the connection elements fail in a ductile manner to avoid failure of the surrounding concrete in a non-ductile manner. Currently available fixing anchors do not provide reliable ductile failure.

DISCLOSURE OF INVENTION

An object of the present invention is the provision of ductile-failure anchors for concrete elements which are cast into said concrete elements and which overcome the disadvantages of the above described anchors by providing reliable ductile failure. A further object of the present invention is the provision of anchors for concrete elements that spread the connection loads to a greater area of the concrete elements than is presently possible, thus allowing a higher strength connection.

The present invention provides a ductile-failure anchor for a concrete element which is cast in said concrete element and which is adapted to accept a connection from an external fixing member, said anchor including: a folded securing means independent of any reinforcing within said element; a connection means which is attached to said securing means, wherein said external fixing member can be secured into said connection means such that said concrete element is securable to another element; wherein said folded securing means includes at least two regions of predetermined length and cross-sectional area, said regions being positioned about said connection means such that when said anchor is overloaded, said regions fail in a ductile manner before any other part of the concrete element fails; and wherein said anchor is contained within the dimensions of said concrete element.

Said regions may include: slots along the centre line of said securing means; areas of reduced width of said securing means; circular holes in said securing means; necking of said securing means; and a combination thereof.

The present invention further provides a ductile-failure anchor for a concrete element which is cast into said concrete element and which is adapted to accept connection from an external fixing member, said anchor including: a folded or bent securing means independent of any reinforcing within said element; a connection means which is adapted to receive thereon or thereabout a portion of said securing means, wherein said member can be secured into or onto said connection means such that said concrete element is securable to another element; wherein said folding means includes at least two regions of predetermined length and cross-sectional area, said regions being positioned adjacent said portion and said connection means such that when said anchor is overloaded, said regions fail in a ductile manner before any other part of said element fails; and wherein said anchor is contained within the dimensions of said concrete element.

Said connection means may include one curved support portion for supporting said portion of each securing means (inbetween two said regions), each support portion being shaped to receive thereon said portion of the securing means, which is arcuate or curved. Preferably the connection means includes one or two bendable lugs positioned and shaped such that they are capable of further securing the securing means in place in place on the support portion, once in position.

The securing means and connection means are placed in position within a mould for the pouring of concrete to form the element, prior to the formation of the concrete element. Preferably the connection means is located within a tubular cavity within a concrete element wherein each cavity is adapted to accept a fixing member. Preferably, each cavity is capable of being lengthened on-site such that it extends from one transverse side of a concrete element to the other.

Preferably each connection means is a screw threaded element and each fixing member is a threaded bar or bolt.

Preferably the folded securing means is folded symmetrically about a connection means such that it forms three sections each at a predetermined angle relative to adjacent sections, on each side of said connection means.

Preferably the folded securing means is selected from one of the following group: two parallel metal bars; a flat metal strap; one or two metal rods of circular or other cross-sectional shape.

BRIEF DESCRIPTION OF THE DRAWINGS

By way of example only, preferred embodiments of the present invention are described with reference to the accompanying drawings in which:

FIG. 3 is a partial section of a concrete element of a third preferred embodiment of the present invention;

FIG. 4 is a side view of the bars of the third preferred embodiment of the present invention on their own;

FIG. 5 is a plan view of the bars in FIG. 4;

BEST MODE OF CARRYING OUT THE INVENTION

Figures 1, 2:
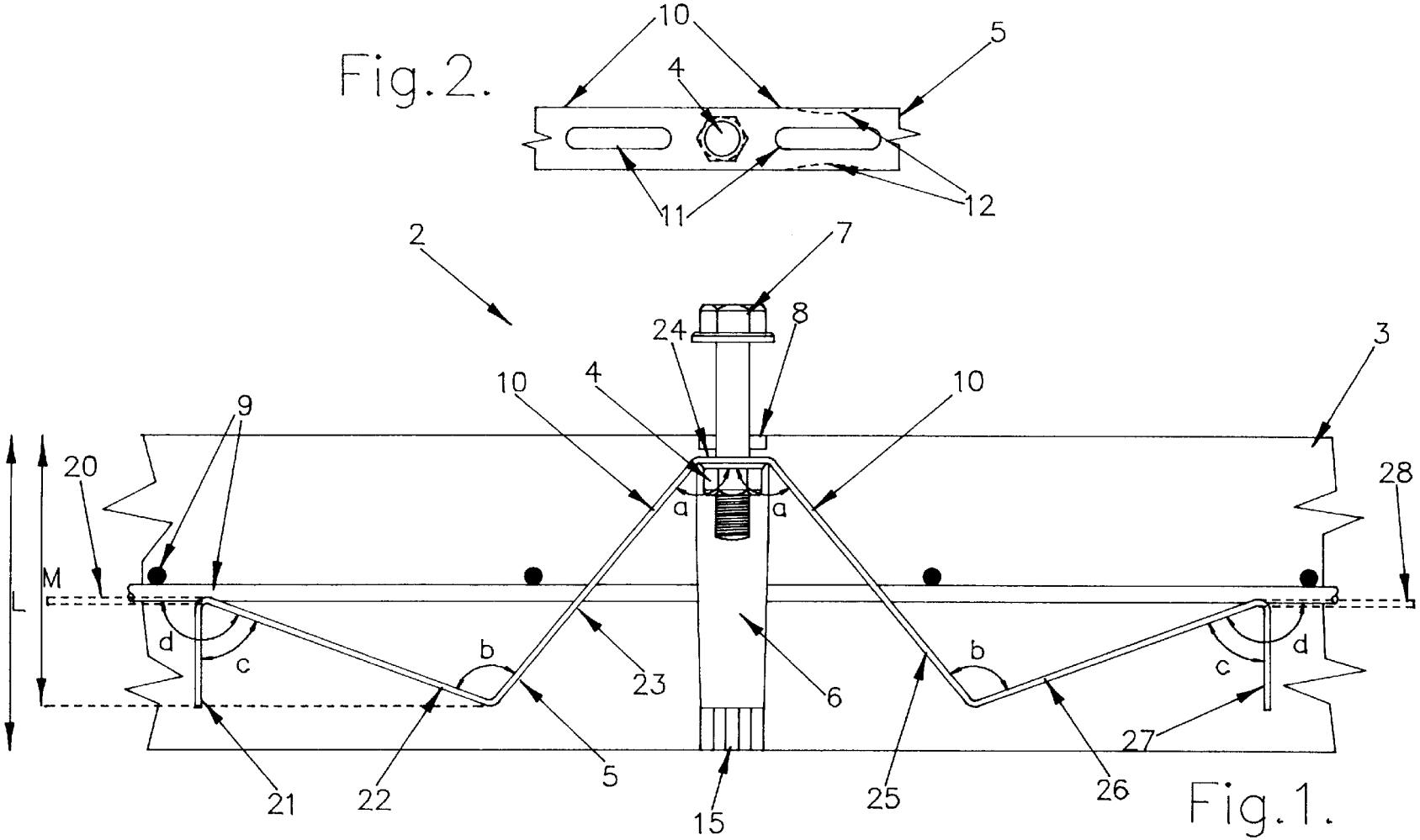
FIG. 1 is a cross section of a first preferred embodiment of the present invention.
FIG. 2 is a plan view of a second preferred embodiment of the securing means of the present invention.
Figure 6:
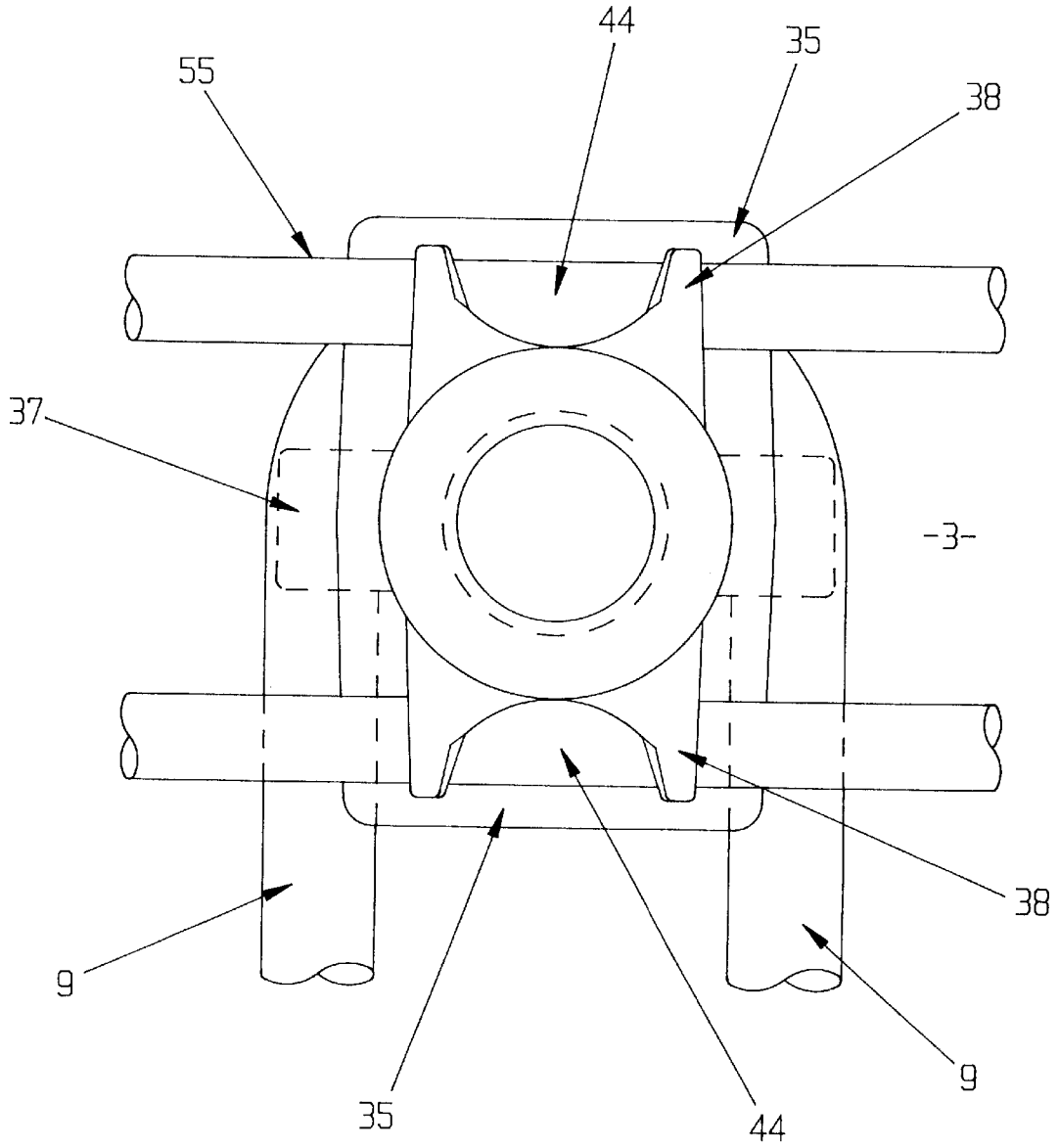
FIG. 6 is a plan view of the third preferred embodiment of the plug of the present invention.

Referring to FIG. 1, a first preferred embodiment of a ductile-failure anchor 2 is thereshown cast into a concrete element 3. The anchor 2 comprises a threaded plastic plug 4 which is firmly attached to a folded pair of parallel metal bars 5, one on each of two opposite sides of said plug 4. The plug 4 is located in a narrow internal cavity 6 within the concrete element 3. A fixing bolt 7 is screwed into the plug 4. The plug 4 is recessed down from the concrete surface in recess 8 to allow easy finishing of the concrete surface. A region of spacing prongs 15 extend from the bottom of the cavity 6 to the bottom surface of the concrete element 3. The prongs 15 can be knocked out on site such that the cavity 6 extends from one surface of the concrete element 3 to the other allowing the fixing bolt 7 to pass fully through the concrete element 3.

The metal bars 5 are folded into seven sections 21 to 27 (each of which can be of constant cross-sectional area) such that a first section 24 is centrally located adjacent or on top of said plug 4 and such that said first section is perpendicular to the longitudinal axis of the fixing bolt 7. A second section 23 extends down from said first section 24 at an angle "a" of approximately 140°. A third section 22 extends up from said second section 23 at an angle "b" of approximately 110°. A fourth section 21 extends down from said third section 22 at an angle "c" of approximately 70°. The remaining sections 25–27 are arranged symmetrically with respect to said second, third and fourth sections, on the opposite side of said first section 24. A tolerance of ±20° is available to the angles "a" and "b" between the sections 22 to 26. Preferably angle "a" should be within a tolerance of ±5°.

The pair of metal bars 5 are approximately parallel and are independent of the reinforcing rods 9 within the concrete element 3. Ductile regions 10 are formed in the sections 23 and 25 of the metal bars 5 on either side of the plug 4. The sections 23 and 25 are of a predetermined length and cross-sectional area such that the ductile regions 10 fail in a ductile manner before the burst load of the respective surrounding concrete is exceeded. The folded metal bars 5 and the plug 4 to which they are secured are contained fully within the dimensions of the concrete element 3.

The angle "c" between sections 21 and 22 and sections 26 and 27 is not critical, and tolerance of ±180° is available. Thus the end sections 21 and 27 can be folded into either of the dotted positions 20 and 28 shown in FIG. 1.

Preferably each of said bars 5 is of circular cross-section. Preferably each of said bars 5 is 6 mm in diameter and each of the bars in a pair of bars 5 are separated from each other by 26 mm (centre to centre). Preferably also each bar 5 has sections 21 to 27 that are co-planar.

Referring to FIG. 2, a part of a second preferred embodiment of a ductile failure anchor 2 is thereshown in which a folded metal strap 5*a* replaces the parallel pair of folded metal bars 5 of the first preferred embodiment. Elements of the second preferred embodiment which are common to the first preferred embodiment are referred to by the same reference numbers. In the second preferred embodiment the ductile regions 10*a* are formed by lengths of reduced cross-sectional area within sections 23 and 25 of the strap 5*a*.

The lengths of reduced cross-sectional area are formed using either slots 41 located along the centre line of the strap 5*a*, or areas of narrowing 42 of the strap 5*a* width or both. Circular holes in or necking of the strap 5*a* as well as more than two slots 41 in the strap 5*a* or a combination of these could also be used.

Preferably the metal strap 5*a* is dimensioned 30 mm in width and 3 mm in depth. Preferably the slots 41 are dimensioned 55 mm in length and 11 mm in width.

Preferably the ratio of the depth "L" (FIG. 1) of the concrete element, to the depth "M" of the first section 23 (and its symmetrical equivalent 25) of the anchor 2 between is 1.2:1 and 1:1. Thus the fail tension at each ductile region 10 or 10*a* of each second section 23 (or 25) is less than the burst load at the corresponding angle "b" between said second section 23 (or 25) and said third section 22 (or 26).

A folded metal rod of circular or other cross-sectional shape could also be used in place of the folded metal bars 5 or strap 5*a*, the ductile regions being formed by the entire length of sections 23 and 25 of the folded rod.

Referring to FIGS. 3 to 6, the ductile anchor 32 within the concrete element 3 is shown in FIG. 1. A plug 34 is of a unitary casting and incorporates a narrow internal cavity 6 with threading to receive therein a fixing bolt 7 (as shown in FIG. 1). The plug 34 is recessed down from the concrete surface, as previously described. The prongs 15 are as previously described in the first preferred embodiment.

In addition to the previously described elements, the plug 34 includes two curved or arcuate support faces 35, one on each of two opposite sides of the plug 34. The faces 35 are positioned immediately below the top surface of the concrete element 3, but deep enough within the element 3 that the metal bar 55 is fully within the concrete element 3. The region 44 of the bar 55 adjacent the faces 35 is curved or arcuate in a shape complementary to that of the support faces 35. This region 44 of the bar 55 corresponds to the first section 24 previously described in the first preferred embodiment.

Thus the regions of ductile failure (represented by B, FIG. 5) will be immediately adjacent the portion 44 supported by each support face 35 (represented by A, FIG. 5).

The remaining sections of the bar 55—second section 43, third section 42, fourth section 41, and remaining sections 45–47, are as previously described for sections 21 to 27 of the first preferred embodiment. The addition in this second preferred embodiment is that the sections 41 and 47 at the ends of the bar 55 are at an angle to the plane in which the adjacent sections (42, 46) lie (as shown in plan in FIG. 5). Sections 42 to 46 are co-planar. Sections 41 and 47 may also be planar with respect to sections 42 to 46, if so desired.

If so desired, foldable lugs (38, FIG. 6) may be formed about the central hollow 6, like a collar. Such lugs 38 are positioned and shaped so as to be capable each of being folded partially over one bar 55 on each support face 35. Also if desired, a support collar 37 (FIGS. 3–6) may be formed as part of the plug 34. Each collar 37 is positioned and shaped to receive thereon a reinforcing rod 9, running at right angles to the bulk of the bar 55. The reinforcing rods 9 are not secured to the collar 37 or plug 34.

Preferably each said plug 34 (including the support faces 35, support collar 37 and foldable lugs 38, if present) is of metal and is a one piece casting which is appropriately machined prior to insertion in the mould for making/forming the concrete element 3. A plastics material may alternatively be used, if so desired.

Preferably said metal bars (5, 55) or said metal strap 5*a* are one of the following group: galvanised steel; stainless steel; and a corrosive resistant steel alloy. Preferably said metal bars (5, 55) or said metal strap 5*a* are bent cold.

Said anchors (2, 32) can be positioned at any length centers along or across said concrete element 3, but are preferably positioned at 2400 mm centers.

Figure 7:
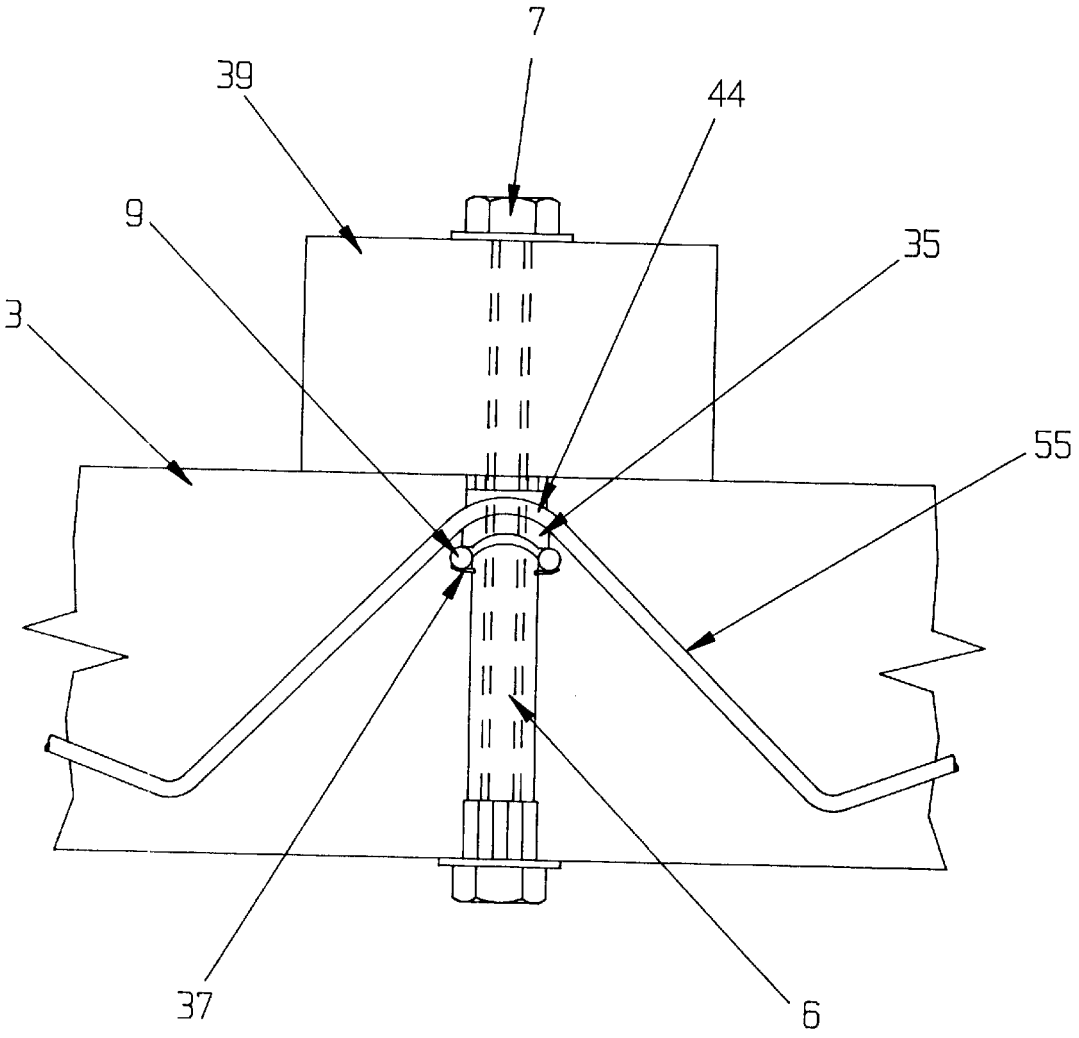
FIG. 7 is a partial side section view of a concrete element, incorporating the third preferred embodiment of the present invention, connected to a second concrete element.

In use the concrete element 3 and a second element (39, FIG. 7), which need not be of concrete, are aligned such that the bolt 7 passes through the second element 39 and is secured to the first element 3 at the plug (4, 34) in known fashion. This fixes the two elements (3, 39) together while allowing ductile failure, in the case of an earthquake or other building disturbance, at the ductile regions (10 and 10*a* or B) of the bars (5, 55) or strap 5*a*. It will be appreciated that the second element 39 may also include a fixing anchor (2, 32).

If so desired, the prongs 15 can be removed to allow the fixing bolt 7 to be first screwed into the plug (4, 34) of the first concrete element 3 and then to pass through the cavity 6 such that it may secure the second element 39 below the first concrete element 3.

In a third arrangement, the elements (3, 39) may be arranged such that they are in perpendicular planes, for example wall and floor elements. A fixing bolt 7 secures the concrete element 3 at its ductile-failure anchor (2, 32) to a (right-angled) fixing member of known type at the end nearest the second element 39. The metal fixing member is then secured to the second element 39 in known fashion.

I claim:

1. A ductile-failure anchor for a concrete element which is cast in said concrete element and which is adapted to accept a connection from an external fixing member, said anchor including: a folded securing means independent of any reinforcing within said element; a connection means which is attached to said securing means, wherein said external fixing member is secured into said connection means such that said concrete element is securable to another element; wherein said folded securing means includes at least two regions of predetermined length and cross-sectional area, said regions being intentionally structurally weakened by selectively removing mass to increase ductility, and being positioned about said connection means such that when said anchor is overloaded, said regions fail in a ductile manner before any other part of the concrete element fails; and wherein said anchor is contained within the dimensions of said concrete element.

2. A ductile-failure anchor for a concrete element as claimed in claim 1 wherein each said region includes at least one of the following: slots along the center line of said securing means; areas of reduced width of said securing means; circular holes in said securing means; necking of said securing means; and a length of said means which is unsupported relative to adjacent portions of said means.

3. A ductile-failure anchor for a concrete element as claimed in claim 2 wherein said folded securing means is folded into seven sections, said sections being:

a support section centrally positioned along the length of said securing means;

two second sections, each second section extending downwardly from said first section, one on each side of said first section, each second section being at an angle a to said first section;

two third sections, each third section extending upwardly from a second section at an angle b to said second section; and two fourth sections, each fourth section extending from a third section at an angle c in respect of two said third sections, wherein the respective second, third and fourth sections are arranged symmetrically about the first section.

4. A ductile-failure anchor for a concrete element as claimed in claim 3 wherein said angle a is between 120° to 160°, said angle b is between 90° and 130° and said angle c is between 70° and 180°.

5. A ductile-failure anchor for a concrete element as claimed in claim 3 wherein each said first section includes one region.

6. A ductile-failure anchor for a concrete element as claimed in claim 1 wherein said securing means is selected from the group consisting of two parallel metal bars; a flat metal strip; one metal rod; two metal rods; and two metal rods of circular cross-section, each rod being placed about the connection means in parallel, one with the other.

7. A ductile-failure anchor for a concrete element as claimed in claim 3 wherein the ratio of the depth of the concrete element to the depth of each first section of the anchor is between 1.2:1 and 1:1.

8. A ductile-failure anchor for a concrete element as claimed in claim 1 wherein said connection means includes a threaded plug located within a narrow internal cavity within the concrete element with a region of spacing prongs extending from the bottom of the cavity to the bottom surface of the concrete element, which prongs are removable on site such that the cavity extends from one surface of the concrete element to the second, allowing a bolt to be passed therethrough.

9. A ductile-failure anchor for a concrete element as claimed in claim 1 wherein said connection means is made from a material selected from the group consisting of: a plastics material, a metal, and a metal alloy, and said securing means is made from a material selected from the group consisting of: galvanized steel, stainless steel, and a corrosive-resistant steel alloy.

10. A concrete element including a plurality of ductile failure anchors which are cast in said concrete element and which are adapted to accept a connection from an external fixing member, each said anchor including: a folded securing means independent of any reinforcing within said element; a connection means which is attached to said securing means, wherein said external fixing member is secured into said connection means such that said concrete element is securable to another element; wherein said folded securing means includes at least two regions of predetermined length and cross-sectional area, said regions being intentionally structurally weakened by selectively removing mass to increase ductility, and being positioned about said connection means such that when said anchor is overloaded, said regions fail in a ductile manner before any other part of the concrete element fails; and wherein said anchor is contained within the dimensions of said concrete element.

11. A ductile-failure anchor for a concrete element wherein said ductile-failure anchor is cast into said concrete element and which is adapted to accept connection from an external fixing member, said anchor including: a folded or bent securing means independent of any reinforcing within said element; a connection means which is adapted to receive a portion of said securing means, wherein said member is secured relative to said connection means such that said concrete element is securable to another element; wherein said folding means includes at least two regions of predetermined length and cross-sectional area, said regions being intentionally structurally weakened by selectively removing mass to increase ductility, and being positioned adjacent said portion and said connection means such that when said anchor is overloaded, said regions fail in a ductile manner before any other part of said element fails; and wherein said anchor is contained within the dimensions of said concrete element.

12. A ductile-failure anchor for a concrete element as claimed in claim 11 wherein each said region includes at least one of the following: slots along the centre line of said securing means; areas of reduced width of said securing means; circular holes in said securing means; necking of said securing means; and a length of said means which is unsupported relative to adjacent portions of said means.

13. A ductile-failure anchor for a concrete element as claimed in claim 12 wherein said connection means includes one curved support portion for supporting a section of each securing means positioned in between two regions, each support portion being shaped to receive thereon said section of the securing means, which portion is arcuate.

14. A ductile-failure anchor for a concrete element as claimed in claim 13 wherein said anchor includes foldable lugs positioned on each side of said connection means, each said lug being positioned and shaped so as to be capable of being folded partially over the first section of the securing means; and a support collar shaped to receive thereon a reinforcing rod forming part of the concrete element.

15. A ductile-failure anchor for a concrete element as claimed claim 14 wherein said folded securing means is folded into seven sections, said sections being:

a support section centrally positioned along the length of said securing means;

two second sections, each second section extending downwardly from said first section, one on each side of said first section, each second section being at an angle a to said first section;

two third sections, each third section extending upwardly from a second section at an angle b to said second section; and two fourth sections, each fourth section extending from a third section at an angle c in respect of two said third sections, wherein the respective second, third and fourth sections are arranged symmetrically about the first section.

16. A ductile-failure anchor for a concrete element as claimed in claim 14 wherein each said first section includes one region.

17. A ductile-failure anchor for a concrete element as claimed in claim 16 wherein said securing means comprises two metal rods of circular cross-section, each rod being placed about the connection means in parallel, one with the other.

18. A ductile-failure anchor for a concrete element as claimed in claim 11 wherein said connection means included a threaded plug located within a narrow internal cavity within the concrete element with a region of spacing prongs extending from the bottom of the cavity to the bottom of the surface of the concrete element, which prongs are removable on site, such that the cavity extends from one surface of the concrete element to the second, allowing a bolt to be passed therethrough.

19. A ductile-failure anchor for a concrete element as claimed in claim 11 wherein said connection means is made from a material selected from the group consisting of: a plastics material, a metal, and a metal alloy, and said securing means is made from a material selected from the group consisting of: galvanised steel, stainless steel, and a corrosive-resistant steel alloy.

20. A concrete element including a plurality of ductile-failure anchors, each said anchor is cast into said concrete element and is adapted to accept connection from an external fixing member, each said anchor including: a folded or bent securing means independent of any reinforcing with said element; a connection means which is adapted to receive a portion of said securing means, wherein said member is secured relative to said connection means such that said concrete element is securable to another element; wherein said folding means includes at least two regions of predetermined length and cross-sectional area, said regions being positioned adjacent said portion and said connection means such that when said anchor is overloaded, said regions being intentionally structurally weakened to increase ductility and fail in a ductile manner before any other part of said element fails; and wherein said anchor is contained within the dimensions of said concrete element.

* * * * *